US005968228A

United States Patent [19]

Ihm et al.

[11] Patent Number: 5,968,228

[45] Date of Patent: Oct. 19, 1999

[54] PROCESS FOR PREPARING COBALT METALS USING NITROGEN REDUCTANT

[75] Inventors: Son-Ki Ihm, Seoul; Do-Woan Kim, Taejon; Dong-Keun Lee, Jinjoo, all of Rep. of Korea

[73] Assignee: Korea Advanced Institute of Science and Technology, Taejon, Rep. of Korea

[21] Appl. No.: 09/148,223

[22] Filed: Sep. 4, 1998

[51] Int. Cl.[6] ..... C22B 23/00; C22B 15/00; C01G 1/00

[52] U.S. Cl. ..... 75/627; 75/430; 423/138

[58] Field of Search ..... 75/430, 627, 365; 423/138

[56] References Cited

U.S. PATENT DOCUMENTS 4,093,450 6/1978 Doyle et al. .

4,452,633 6/1984 Miller et al. .

4,612,039 9/1986 Scheithauer et al. ..... 75/362

*Primary Examiner*—George Wyszomierski

*Assistant Examiner*—Tima McGuthry Banks

*Attorney, Agent, or Firm*—Knobbe, Martens, Olson & Bear, LLP

[57] ABSTRACT

The present invention relates to a process for preparing cobalt metals by reducing cobalt oxides with ammonia or nitrogen/hydrogen gas mixtures. In accordance with the present invention, a cobalt metal is economically prepared by reacting a cobalt oxide with a nitrogen reductant at a temperature of 300 to 550° C. for 3 to 7 hours, where the nitrogen reductant is injected into a reactor containing the cobalt oxide at a flow rate of 300 to 700 cc/min, preferably 500 cc/min per 1 g of cobalt oxide, while continuously elevating the temperature of the reactor at a rate of 3 to 7° C./min, most preferably 5° C./min.

5 Claims, 1 Drawing Sheet

PROCESS FOR PREPARING COBALT METALS USING NITROGEN REDUCTANT

FIELD OF THE INVENTION

The present invention relates to a process for preparing cobalt metals using nitrogen reductants, more specifically, to a process for preparing cobalt metals by reducing cobalt oxides with ammonia or nitrogen/hydrogen gas mixture.

BACKGROUND OF THE INVENTION

Cobalt is one of the major metal components which are widely used in various alloys and catalysts. Cobalt is widely distributed in a level of 0.001 to 0.002% in nature, however, it generally exists as an oxide form. Though, most of cobalt metals used in catalysts, alloys and so on, have been collected to prevent environmental pollution, however, they also exits in a form of oxide.

Therefore, many studies have focused on the preparation of highly pure cobalt metals. For example, U.S. Pat. No. 4,093,450 and U.S. Pat. No. 4,452,633 disclose the processes for preparing cobalt metals by reducing cobalt oxides at a high temperature ranging 500 to 775° C. However, the said processes consume high expenses for equipment and operation, since they essentially accompany a reaction step carried out at the high temperature. In addition, Massoth teaches that the cobalt oxides can be reduced in an impregnated form in alumina carrier by hydrogen, however, the efficiency is so low that it cannot be practised in industrial application(s: F. E. Massoth, J. Catal., 15:179(1973)).

Under the circumstances, there are strong reasons for developing an alternative means of preparing cobalt metals at a low temperature with a high degree of purity.

SUMMARY OF THE INVENTION

The present inventors have made an effort to solve the crucial problems of the conventional methods for preparing cobalt metals, and finally found that: cobalt metals of high purity can be successfully prepared at a relatively low temperature by reducing cobalt oxides with ammonia or nitrogen/hydrogen gas mixture.

A primary object of the invention is, therefore, to provide a process for preparing cobalt metals by reducing cobalt oxides with ammonia or nitrogen/hydrogen gas mixture.

BRIEF DESCRIPTION OF DRAWINGS

The above and the other objects and features of the present invention will become apparent from the following description given in conjunction with the accompanying drawing, in which.

DETAILED DESCRIPTION OF THE INVENTION

Figure 1:
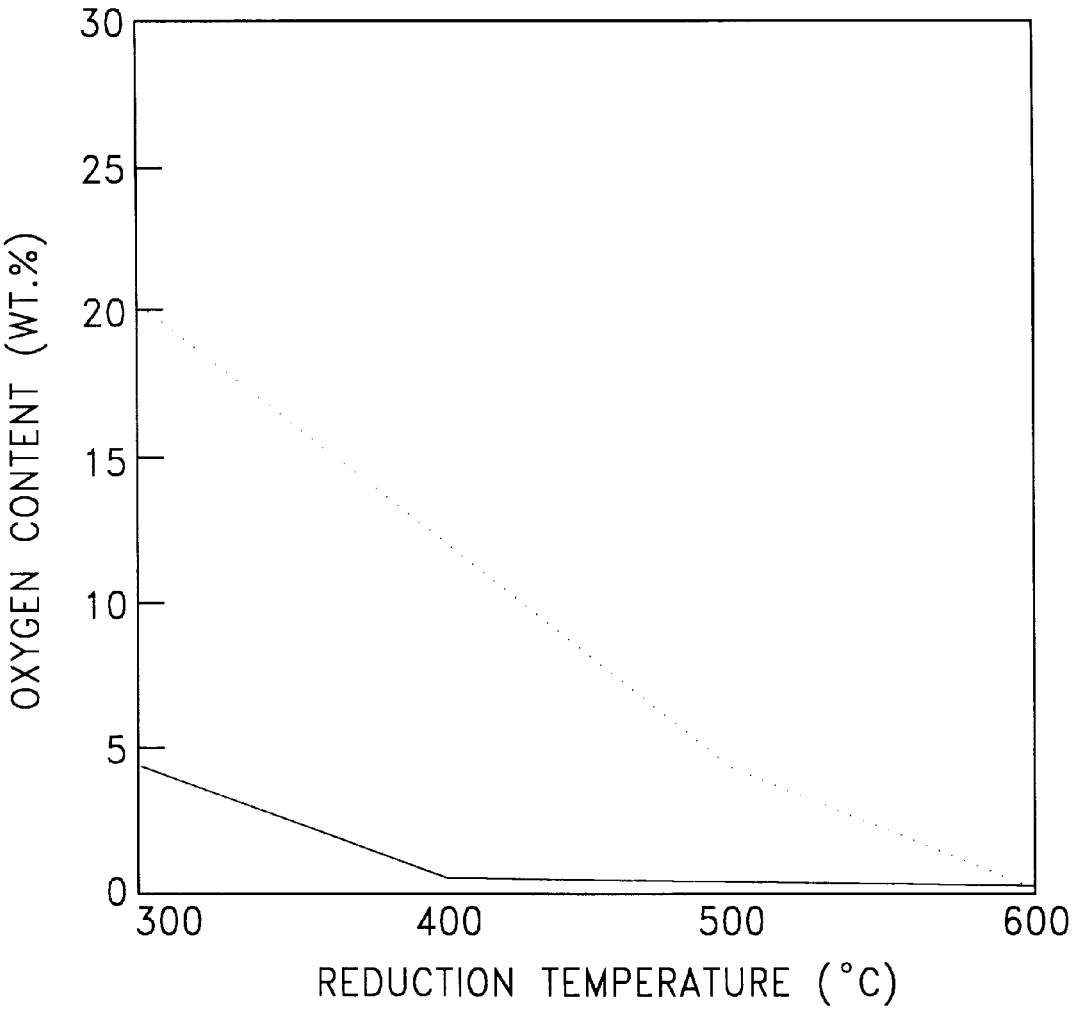
FIG. 1 is a graph showing the reduction temperature-dependence of oxygen contents in cobalt metals which were prepared by the invented method and the conventional method, respectively.

In accordance with the present invention, a cobalt metal is prepared by reacting a cobalt oxide with a nitrogen reductant at a temperature of 300 to 550° C. for 3 to 7 hours, where the nitrogen reductant is injected into a reactor containing the cobalt oxide at a flow rate of 300 to 700 cc/min, preferably 500 cc/min per 1 g of cobalt oxide, while continuously elevating the temperature of the reactor at a rate of 3 to 7° C./min, most preferably 5° C./min.

The cobalt oxide employed in the invention includes commercially available cobalt compounds such as cobalt monoxide(CoO), tricobalt tetroxide ($Co_3O_4$) and various cobalt oxide mixtures, while the cobalt oxide may be employed as an impregnated form in a carrier of alumina, active carbon, titania or silica at a cobalt oxide content of 5 to 15 wt.% against the carrier. On the other hand, the nitrogen reductant includes ammonia or nitrogen/hydrogen gas mixture whose hydrogen composition ratio is 30 to 80 (v/v)%.

The present invention is further illustrated in the following examples, which should not be taken to limit the scope of the invention.

EXAMPLE 1

Preparation of Cobalt Metal using Ammonia 1g of tricobalt tetroxide ($Co_3O_4$, Aldrich Chemical Company, USA) was added to a reactor of quartz, and ammonia was injected into the reactor at a flow rate of 500 cc/min while continuously elevating the temperature of the reactor at a rate of 5° C./min upto 300° C. And then, the temperature of the reactor was maintained for 5 hours to give a cobalt metal.

EXAMPLE 2

Preparation of Cobalt Metal using Ammonia

Cobalt metal was prepared analogously as in Example 1 with the exception of elevating the temperature of the reactor upto 400° C.

EXAMPLE 3

Preparation of Cobalt Metal using Ammonia

Cobalt metal was prepared analogously as in Example 1 with the exception of elevating the temperature of the reactor upto 500° C.

EXAMPLE 4

Preparation of Cobalt Metal using Ammonia

Cobalt metal was prepared analogously as in Example 1 with the exception of elevating the temperature of the reactor upto 600° C.

Comparative Example 1

Preparation of Cobalt Metal using Hydrogen

Cobalt metal was prepared analogously as in Example 1 with the exception of using hydrogen.

Comparative Example 2

Preparation of Cobalt Metal using Hydrogen

Cobalt metal was prepared analogously as in Example 2 with the exception of using hydrogen.

Comparative Example 3

Preparation of Cobalt Metal using Hydrogen

Cobalt metal was prepared analogously as in Example 3 with the exception of using hydrogen.

Comparative Example 4

Preparation of Cobalt Metal using Hydrogen

Cobalt metal was prepared analogously as in Example 4 with the exception of using hydrogen.

EXAMPLE 5

Measurement of Purity of Cobalt Metal

The oxygen contents of the cobalt metals obtained in Examples 1–4 and Comparative Examples 1–4 were measured by the aid of an atomic analyzer(Elementar Analysensystem, Germany). FIG. 1 is a graph showing the reduction temperature-dependence of oxygen contents in cobalt metals which were prepared by the invented method and the conventional method, respectively. In FIG. 1, (—,—,—)represents the oxygen contents in the cobalt metals obtained in Examples 1–4, and ( - - - ) represents those of the cobalt metals of Comparative Examples 1–4. As can be seen in FIG. 1, it was clearly demonstrated that cobalt metals of high purity can be prepared by the present invention at a relatively low temperature range, i.e., 300 to 550° C., when compared with the conventional methods.

EXAMPLE 6

Preparation of Cobalt Metal using Cobalt Oxide Impregnated in a Carrier

An aqueous solution containing cobalt oxide was prepared by dissolving 4.9 g of cobaltnitrate hexahydrate($Co(NO_3)_2 \cdot 6H_2O$) in 5 ml of distilled water and to the cobalt solution was added 10 g of alumina carrier. Subsequently, the solution was dried at 110° C. and calcinated at 500° C. for 5 hours, to give a cobalt oxide impregnated in alumina carrier where cobalt oxide content is 10 wt.% against the carrier. And then, cobalt metal was prepared analogously as in the Example 3 with the exception of using the cobalt oxide impregnated in alumina carrier.

The impregnated form of cobalt metal thus prepared was analyzed by the aid of a x-ray diffraction analyzer (Rigaku Model D/MAX-PC, Japan), which shows that the characteristic peak of cobalt metal was appeared instead of that of cobalt oxide. Accordingly, it was clearly demonstrated that the cobalt oxide impregnated in the carrier was successfully reduced in a quantitative manner.

As clearly illustrated and demonstrated as aboves, the present invention provides a process for preparing cobalt metals by reducing cobalt oxides with ammonia or nitrogen/hydrogen gas mixture. In accordance with the invention, highly pure cobalt metals can be economically prepared at a relatively low temperature, from cobalt oxides or cobalt oxides impregnated in carrier.

What is claimed is:

1. A process for preparing a cobalt metal which comprises a step of reacting a cobalt oxide with a nitrogen containing reductant at a temperature of 300 to 550° C. for 3 to 7 hours.

2. The process of claim 1, wherein the cobalt oxide is reacted with the nitrogen containing reductant by injecting the nitrogen containing reductant into a reactor containing the cobalt oxide at a flow rate of 300 to 700 cc/min per 1 g of cobalt oxide while continuously elevating the temperature of the reactor at a rate of 3 to 7° C./min.

3. The process of claim 1, wherein the cobalt oxide is an impregnated form in a carrier at a cobalt oxide content of 5 to 15 wt.% with respect to the carrier.

4. The process of claim 3, wherein the carrier is selected from the group consisting of alumina, active carbon, titania and silica.

5. The process of claim 1, wherein the nitrogen containing reductant is ammonia or a nitrogen/hydrogen gas mixture whose hydrogen composition ratio is 30 to 80 (v/v)%.

* * * * *